United States Patent [19]

Vandebult

[11] 4,373,163

[45] Feb. 8, 1983

[54] LOOP ANTENNA FOR SECURITY SYSTEMS

[75] Inventor: Jan Vandebult, Topsfield, Mass.

[73] Assignee: I.D. Engineering, Inc., Ipswich, Mass.

[21] Appl. No.: 168,484

[22] Filed: Jul. 14, 1980

[51] Int. Cl.[3] ..... H01Q 7/04; G08B 13/24

[52] U.S. Cl. ..... 343/842; 340/572

[58] Field of Search ..... 343/842; 340/572

[56] References Cited

U.S. PATENT DOCUMENTS

| | | | |
|---|---|---|---|
| 2,350,337 | 6/1944 | Brunner | 343/842 |
| 2,419,577 | 4/1947 | Libby | 343/842 |
| 4,251,808 | 2/1981 | Lichtblau | 343/842 |

*Primary Examiner*—Eli Lieberman

*Attorney, Agent, or Firm*—Schwartz, Jeffery, Schwaab, Mack, Blumenthal & Koch

[57] ABSTRACT

Disclosed is a loop antenna for the propagation of electromagnetic radiation with minimal electrostatic radiation for use in security systems. At least a single loop of conductor forms the radiating surface of the antenna. However, the loop is disposed in a tubular electrostatic shield which serves to minimize electrostatic radiation while not significantly interfering with the desired electromagnetic radiation. In preferred embodiments the electrostatic shield may be electrically grounded or a resistor may be placed in the conduction loop of the antenna to broaden the frequency response thereof. Additional preferred embodiments include twisting the single loop antenna one or more times such that two or more lobes are provided forming a twisted loop antenna. Far-field cancellation of transmitted signals is achieved and there is self cancellation in this antenna of received common mode signals. Additionally, the twisted loop antenna in a preferred embodiment has an electrostatic shield comprising a single unbroken loop of metal tubing around the periphery of the loop with at least one gap occurring in the electrostatic shielding where the shielding covers the conductor along the common side of adjacent lobes.

4 Claims, 7 Drawing Figures

LOOP ANTENNA FOR SECURITY SYSTEMS

BACKGROUND OF THE INVENTION

The present invention relates generally to antennas and specifically to antennas designed for maximum magnetic radiation with minimum electrostatic radiation.

When current flows through a wire, two separate and distinct fields are created. An electrostatic field, and a magnetic field together form an electromagnetic field which is the basis for radio and television transmissions. The Federal Communications Commission (FCC) regulates the radiation of electromagnetic fields (by setting maximum permissible levels of radiation 100 feet from the unlicensed transmitter) in order to provide some order in the utilization of the various radio frequencies. Because the electrostatic or magnetic fields separately do not lend themselves to propagation over extended distances, there is no Federal regulation of these fields.

It has recently become advantageous to utilize electromagnetic fields to provide security in libraries, stores, etc. Generally, an article to be protected has a coil, foil strip, or some other security device which, in response to a changing electromagnetic field, resonates and provides a change in the field which is then detected. Thus, when the article with the security device mounted thereon is brought into close proximity to the electromagnetic transmitter/receiver antenna, the change in the field can be detected and consequently sets off an alarm. A further discussion of the history of a typical security system is set forth in U.S. Pat. No. 4,074,249 to Minasy and in U.S. Pat. No. Re. 29,610, reissued to Minasy et al., said patents herein incorporated by reference.

It is desirable where such a security detection system is utilized in a department store, to have the antennas as inobtrusive as possible so that customers feel free to walk into and out of the store without fear of being falsely detected. On the other hand, it is desirable to have complete security coverage in terms of the antenna radiation pattern of the entry way in order to detect whether items are being surreptitiously removed from the store.

One solution to the problem of ensuring adequate electromagnetic radiation for detection of the security device with a limited antenna size is to increase the strength of the electromagnetic radiation field. However, this results in increased radiation which may rise above the FCC permissible maximum for non-licensed transmitters. Accordingly, to exceed these maximum limits, exemptions from the FCC regulations are required. Most recently, several of the major manufacturers of such security systems applied successfully for exemptions from the electromagnetic field generation requirements based on the premise that they could not otherwise properly operate their security system.

A further problem is that it is desirable to have the receiving antenna extremely sensitive to extremely weak electromagnetic signals in the immediate vicinity of the antenna but essentially non-responsive to electromagnetic signals generated some distance away from the antenna (far-field radiation). Prior art security systems have dealt with this problem by having extremely narrow bandpass receivers such that the receiver is responsive only to a single small band of frequencies thus cutting down the likelihood of spurious electromagnetic radiation setting off the alarm system inadvertently.

Another difficulty with prior art antenna systems such as that shown in U.S. Pat. No. 4,016,553 to Novikoff et al., is that although the antennas are connected in bucking relationship (to reduce far-field radiation), the size necessary to so orient the two or three antenna elements requires structures approximately a foot wide and a foot deep on each side of the opening which is to be protected. A further problem is that even this two or three element antenna does not provide strong electromagnetic fields in all planes and thus the performance of this security system is seriously degraded in certain planes. In this particular system, the orientation of a resonant tag security device in a horizontal plane would essentially be undetected.

Finally, many of the above-described antennae are sensitive to the human touch to the point that the alarm will be activated when one or both antennae are touched by hand. Additionally, when an electrostatic shield is made up of separate metal sections there is a problem with contact.

SUMMARY OF THE INVENTION

In accordance with the above disadvantages, it is an object of the present invention to provide a loop antenna which has strong magnetic radiation properties with extremely weak electrostatic radiation properties.

A further object of the present invention is to provide a loop antenna for security systems which is strong and rugged and yet unobtrusive in appearance.

A further object is to provide a loop antenna which is not sensitive to touching or sensitive to electrostatic noise.

It is a still further object of the present invention to provide a twisted loop antenna which produces far-field cancellation when used in conjunction with a transmitter and which reduces common mode interference when used in conjunction with a receiver.

It is an additional object of the present invention to provide an antenna which has a solid outer tube and is thus structurally strong while at the same time providing for far-field cancellation and common mode signal rejection.

The above and other objects are achieved in accordance with the present invention by providing a loop antenna having at least one conductive loop surrounded by an electrostatic shield. In preferred embodiments, the electrostatic shield is a loop of metal tubing in which the conductor is disposed in an insulated fashion. The electrostatic shield in such a single untwisted loop antenna has a gap in the electrostatic shielding to prevent shorting of the magnetic field as well. In a preferred embodiment of this antenna a twisted loop is provided in which a single loop is twisted at least once to form two adjacent lobes much like a figure "8." In this embodiment, the outer portion of the numeral 8 has a solid tube electrostatic shield with the gap occurring in crossover or common side between adjacent lobes. In preferred embodiments of the shielded loop antennas, the shield can be grounded and the conductor can include resistors therein to broaden the frequency response thereof. Placing two twisting loop antennas side by side with a 90 degree angle between the planes of the antennas results in a very strong magnetic field in all three directions with far-field and common mode signal cancellation.

BRIEF DESCRIPTION OF THE DRAWINGS

A more complete appreciation of the invention and the attendant advantages thereof will be more clearly understood by reference to the following drawings wherein.

DETAILED DESCRIPTION OF PREFERRED EMBODIMENTS

Figure 1:
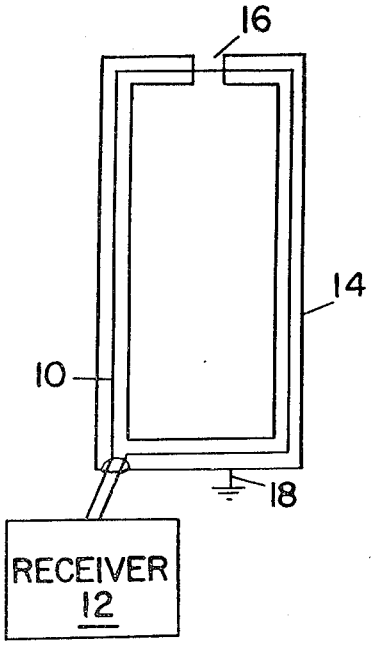
FIG. 1 is a side view of a single loop electrostatically shielded antenna in accordance with the present invention.

Referring now to the drawings wherein like reference characters designate like parts throughout the several views, FIG. 1 is a side view of a single loop antenna connected to a receiver. At least a single loop of conductive material 10 is connected to receiver 12. This is an unbroken loop and picks up electromagnetic radiation in the normal manner. However, surrounding the conductor 10 in the antenna loop is an electrostatic shield 14 comprised of metal. A gap 16 is provided in the electrostatic shield coverage of the loop, which gap is necessary to prevent shorting of the magnetic field.

In preferred embodiments of the loop antenna, the electrostatic shield by suitable connection 18 may be electrically grounded. This arrangement lends itself to the mounting of the single loop antenna on a metal base which forms an inobtrusive antenna for security systems in various public places. It should be noted that the conductor 10 is insulated such that it does not contact the electrostatic shield 14. Furthermore, instead of a single loop, a number of loops of conductors could be utilized in the same manner as a coil of wire has a plurality of loops of conductors. For simplicity sake in FIG. 1 and the other drawings, only a single conductor has been illustrated. It is further understood that instead of receiver 12, a transmitter or a transmitter/receiver could be connected to conductor 10. Thus, it is clear that this electrostatically shielded antenna could be utilized either as a transmitting or receiving antenna.

Figure 2:
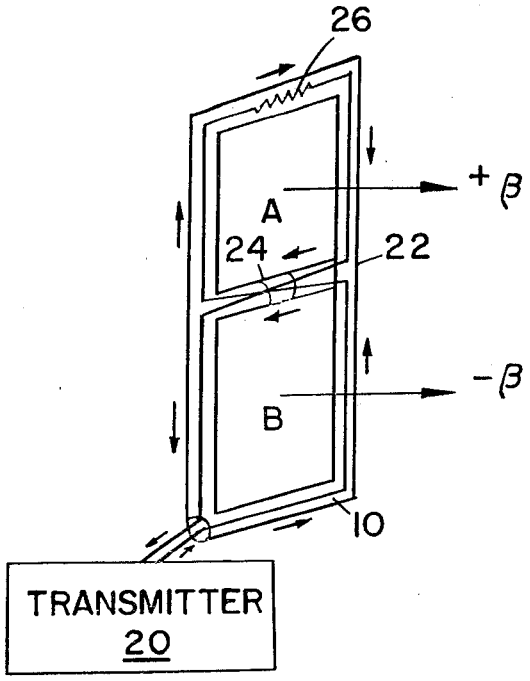
FIG. 2 is a perspective view of a shielded, twisted loop antenna.

FIG. 2 illustrates a preferred embodiment of the electrostatically shielded antenna which comprises a twisted loop forming adjacent lobes A and B. As in FIG. 1, a conductor 10 is arranged in a single continuous loop with the loop twisted 180 degrees in its center portion. Consequently, the conductor appears to be a "figure 8." As can be seen, due to the twist in the loop, current flow in the crossover region (the common side of adjacent lobes A and B) has current flowing in the same direction. However, the circulation of current flow as shown in FIG. 2 will be clockwise in lobe A and counterclockwise in lobe B. If the electromagnetic field generated by lobe A is $+\beta$ the strength of the electromagnetic field generated by lobe B will be $-\beta$. Thus, at a large distance, the combined electromagnetic field will be zero. However, for short distances and except for the precise horizontal plane which passes through the crossover region, the field will be either positive or negative but will have a definite electromagnetic strength. Consequently, when the antenna of FIG. 2 is connected to a transmitter 20, the far-field radiation will cancel although there will be strong magnetic field pattern in the immediate vicinity of the antenna.

As in FIG. 1, the conductor 10 is surrounded by an electrostatic shield 22 which is unbroken around the perimeter of the antenna conductor. This is because the electromagnetic field generated by the conductor acts in opposite directions where the perimeter joins the crossover section. However, a gap 24 is provided in the electrostatic shield in the region of the crossover to prevent shorting of the electromagnetic field and functions in the same manner as the gap 16 of FIG. 1. This gap can be a relatively small distance and be filled with a non-ferromagnetic insulator such as plastic, or the electrostatic shielding for the crossover area can be eliminated completely with the insulated conductor wires in the crossover section passing between holes in the outer perimeter tube.

In preferred embodiments of the twisted loop antenna, a resistance 26 serves to flatten the frequency response of the antenna. A typical resistance utilized in an antenna for a security system application would be in the neighborhood of 200 to 400 ohms. Although only one such resistor is shown operating in lobe A of the FIG. 2 antenna, it will be clear to one of ordinary skill in the art that such a resistor could be added in lobe B as well if desired. Additionally, suach a resistor could be utilized in the single untwisted loop shown in FIG. 1 for the same purpose.

Figure 3:
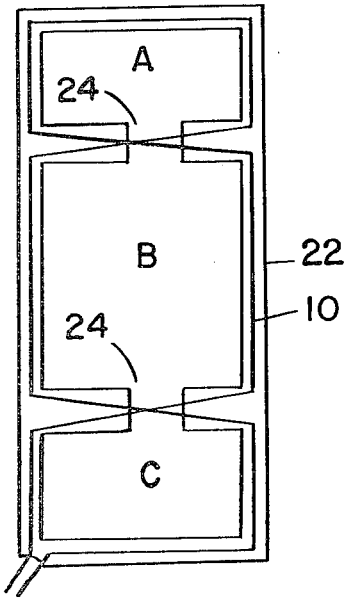
FIG. 3 is a side view of a further embodiment of the twisted loop antenna.

FIG. 3 shows a further embodiment of the twisted loop antenna of FIG. 2 which has two twists forming three separate lobes, identified as A, B and C. Here, where the width of each lobe is the same but the vertical length of the lobes may be different, some consideration must be given to the field cancellation at a distance from the antenna. Essentially what is necessary is that the vector sum of the inductances from the lobes be equal to zero. Because the inductance is a function of the length of wire involved and the current flowing therethrough, it can be seen from FIG. 3 that in order to have a vector sum at a distance equal to zero, the sum of the vertical portions of lobes A and C must equal the vertical portions of lobe B. This is because the circulation in adjacent lobes is in opposite directions. Thus, the current flow in lobes A and C will be in the same direction and this direction will be opposite to the current flow in lobe B. Thus, in FIG. 3 where the width of each lobe is identical, the area of lobe B must equal the sum of areas of lobes A and C in order to obtain far-field cancellation.

The advantage of the multiple twisted loops (the double twisted loop shown in FIG. 3 included) is that very effective far-field cancellation is achieved while at the same time reducing the extent of the null plane which exists in the vicinity of the crossover point as previously discussed with reference to FIG. 2.

Figure 4:
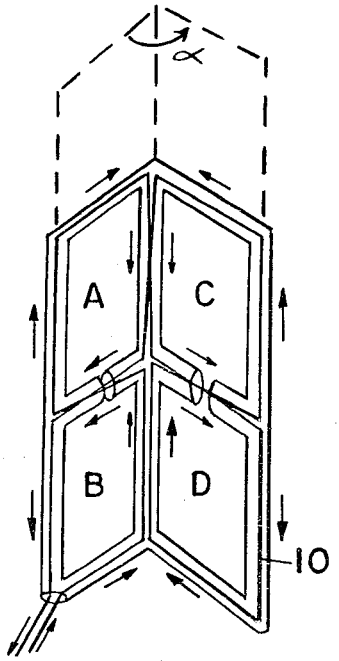
FIG. 4 is a side view of a still further embodiment of a twisted loop antenna.

FIG. 4 teaches a single conductor 10 (or conductor coil) which is wound to form lobes A, B, C and D. The plane of lobes A and B is at an angle $\alpha$ with the plane of lobes C and D. This provides a strong electromagnetic field in all three directions and reduces to a minimal level the null plane which in this embodiment would be in the plane of the crossovers between lobes A and B and lobes C and D. The FIG. 4 embodiment, like those of FIGS. 2 and 3, will have a continuous unbroken tube bounding the periphery of the structure with the provision of gaps 24 only in the crossover regions. If the vertical lengths of conductor segments in lobes A–D are equal and if the horizontal conductor segments in the lobes are equal, the array would be completely self cancelling at a distance. Although dependent upon the application and the antenna pattern desired, the angle $\alpha$ in a preferred embodiment is 90 degrees. Arrows are provided in FIG. 4 to show the conduction path of electricity through the antenna and to illustrate that where two conductors run parallel to each other, their current flow is in the same direction permitting their electromagnetic fields to add in the same manner as the electromagnetic fields add in a coil of wire.

Figure 5:
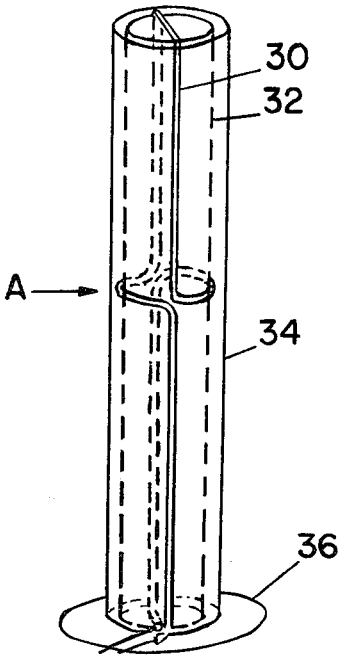
FIG. 5 is a perspective view of a still further embodiment of the present invention.

A further embodiment of the twisted loop antenna is shown in FIG. 5 in which coaxial cable 30 is wrapped around an inner cylinder 32 to form an effective twisted loop antenna much like that disclosed in FIG. 2. The inner conductor of the coaxial cable serves to accomplish the function of conductor 10 in FIGS. 1–4 with the outer sheathing serving to provide the necessary electrostatic shielding. At the effective crossover point indicated by arrow A, the fact that the electrostatic shielding does not touch accomplishes the function of gap 24 in FIG. 2. Additionally, gaps could be provided in the coaxial shielding on the short horizontal segment at the top of the column. For protection of the coaxial cable, an outer column 34 could be added along with a base 36 for mounting, which makes it extremely insensitive to touching by hand or hitting with shopping carts.

Figure 6:
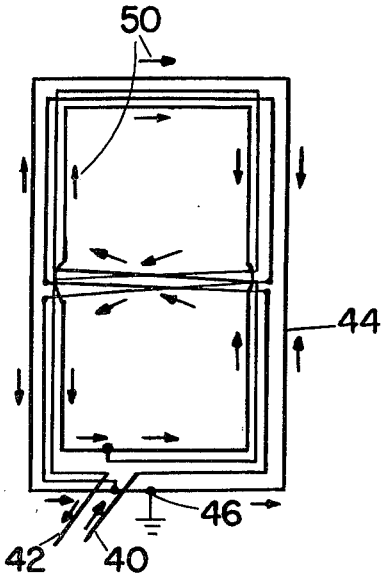
FIG. 6 is a side view of the antenna arrangement in FIG. 2 with an alternative coil arrangement therein.

In a further embodiment of the twisted loop antenna shown in FIG. 2, FIG. 6 discloses a single twisted loop wherein there are two separate conductors which comprise inputs 40 and 42. By carefully tracing the path of each input it can be seen that each of the two conductors describes a FIG. 8 and is then connected to the electrostatic shield 44 which is grounded through connection 46 (although this is not a requirement for operation). Arrows 50 illustrate that with conductors 40 and 42 connected to the output of a transmitter or the input of a receiver, the electromagnetic field will add rather than oppose each other in adjacent conductor segments.

Figure 7:
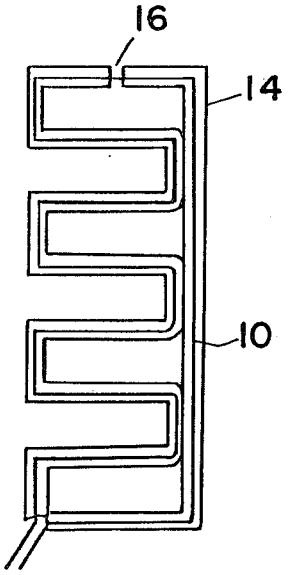
FIG. 7 is a further embodiment of the single loop shielded antenna in accordance with FIG. 1.

A further embodiment of the untwisted loop antenna of FIG. 1 is shown in FIG. 7 where conductor 10 travels in a serpentine path along one or more sides of the loop. The multiple bends on the left-hand side of the vertical portion of the loop as shown in FIG. 7 serve to increase the ability of the antenna to detect the presence of the security device at a number of different vertical positions. As with FIG. 1, a gap 16 is provided in the electrostatic shield 14 to prevent short-circuiting of the electromagnetic field as well. It should be noted that although FIG. 7 appears to indicate that portions of the electrostatic shield contact other portions, there is no electrical contact between the electrostatic shield portions and thus the electromagnetic field generated in each of the partial loops will not be short-circuited.

It should be noted that any of the antennas depicted can be used either with a transmitter, a receiver, or a transmitter/receiver combination. When used in combination with a transmitter, the twisted loop embodiments as discussed above will have far-field cancellation without near-field cancellation. When used with a receiver, the embodiment depicted in FIGS. 2–6 will reduce or eliminate common mode signals generated at a distance from the antenna. Furthermore, all of the twisted mode antennas are characterized by the advantage than an unbroken electrostatic shield tube can be utilized around their perimeter with gaps necessary only in the crossover section. Clearly, however, if gaps in the crossover area were not desirable, then gaps could be provided elsewhere in the electrostatic shielding to prevent short-circuiting of the electromagnetic field.

Although the invention has been described relative to specific embodiments thereof, it is not so limited and many modifications and variations thereof will be readily apparent to those skilled in the art in light of the above teachings. For example, in the twisted loop antenna, any number of twists can be utilized with resultant far-field cancellation subject only to the caveat noted earlier with regard to the desirability of the vector sum of field inductance being equal to zero. In the crossovers, although a preferred embodiment according to FIG. 2 has electrostatic shielding, it is not necessary to include this shielding as illustrated in FIG. 6. The input connections to the antennas can be anywhere that is convenient although the bottom center portion may be preferred. A resistor or resistance can be utilized in any of the conductors noted above in order to flatten the frequency response of the antennas with the amount and number of resistances and the degree of flattening determined by the desired operational frequency. The electrostatic shields can advantageously be grounded although this is not necessary for proper operation. The number of loops of conductor as noted earlier can be more than one with the only caveat that to increase efficiency, each loop of conductor be insulated from an adjacent loop of conductor and from the electrostatic shield itself. It is, therefore, to be understood, that within the scope of the appended claims, the invention may be practiced otherwise than as specifically described.

The embodiments of the invention in which an exclusive property or privilege is claimed are defined as follows:

1. A loop antenna for propogating or receiving electromagnetic radiation but not electrostatic radiation in conjunction with a security system for identifying the presence or absence of at least one resonant tag circuit in the presence of said antenna, said security system including at least one transmitter and at least one receiver, said antenna defined as a twisted loop antenna comprising:

a conductor formed in at least one twisted loop wherein a portion of a single loop is twisted at least 180° to form at least two adjacent, separate lobes of the same loop such that with a given current flow in said loop, said current circles in opposite directions in said adjacent lobes, said twisted loop having a perimeter and a common side between adjacent lobes;

electrostatic shielding surrounding said perimeter of said twisted loop and surrounding said common side, a first insulative gap formed in said shielding surrounding said perimeter, and a second insulative gap formed in said shielding surrounding said common side, wherein said conductor and said shielding comprise a coaxial cable; and further comprising a cylindrical form around which said coaxial cable is wrapped to form said twisted loop in the form of a figure "8" with a cross-over between adjacent loops traveling circumferentially around said cylindrical form to produce said common side, and said shielding of said cable at said cross-over being isolated against electrical contact to form said second gap.

2. The loop antenna according to claim 1 and further including cylindrical means for covering said coaxial cable and said cylindrical form, said covering means including a base for mounting said cylindrical form.

3. The loop antenna according to claim 1 wherein said first gap comprises an opening in the shielding of said coaxial cable.

4. The loop antenna according to claim 1 wherein said shielded cable extends around opposite halves of said cylindrical form to form said cross-over.

* * * * *